US007430877B2

(12) United States Patent
Davenport et al.

(10) Patent No.: US 7,430,877 B2
(45) Date of Patent: Oct. 7, 2008

(54) AIR CONDITIONING APPARATUS AND ASSOCIATED CONDENSATE DRAIN PAN STRUCTURE

(75) Inventors: Bradford B. Davenport, Greenwood, AR (US); Kenneth D. Frederick, Fort Smith, AR (US); Neil D. Hurt, Huntington, AR (US)

(73) Assignee: Rheem Manufacturing Company, Atlanta, GA (US)

( * ) Notice: Subject to any disclaimer, the term of this patent is extended or adjusted under 35 U.S.C. 154(b) by 483 days.

(21) Appl. No.: 11/287,702

(22) Filed: Nov. 22, 2005

(65) Prior Publication Data

US 2007/0113574 A1 May 24, 2007

(51) Int. Cl.
*F25B 21/14* (2006.01)

(52) U.S. Cl. ..... 62/285; 62/272

(58) Field of Classification Search ..... 62/272, 62/279, 285, 291

See application file for complete search history.

(56) References Cited

U.S. PATENT DOCUMENTS

| | | | | |
|---|---|---|---|---|
| 4,410,033 | A | 10/1983 | Wawro et al. | |
| 4,474,232 | A | 10/1984 | Wright et al. | |
| 4,513,586 | A | 4/1985 | Jennings et al. | |
| 4,843,835 | A | 7/1989 | Goetz et al. | |
| 4,856,672 | A * | 8/1989 | Sullivan | 220/571 |
| 4,907,420 | A | 3/1990 | Mahanay et al. | |
| 5,071,027 | A | 12/1991 | Sullivan | |
| 5,174,467 | A | 12/1992 | Sullivan | |
| 5,481,886 | A | 1/1996 | Hasegawa et al. | |
| 5,511,386 | A * | 4/1996 | Russ et al. | 62/285 |
| 5,664,430 | A | 9/1997 | Karman | |
| 5,787,721 | A | 8/1998 | Fromm et al. | |
| 5,966,959 | A | 10/1999 | Stewart | |
| 6,196,015 | B1 | 3/2001 | Pignolo | |
| 6,346,096 | B1 | 2/2002 | Yam et al. | |
| 6,497,255 | B1 | 12/2002 | Adams et al. | |
| 6,931,882 | B1 | 8/2005 | Yang | |

OTHER PUBLICATIONS

Rheem "Self-Contained Heat Pump Package Units" brochure sheets (Mar. 2004).

* cited by examiner

*Primary Examiner*—Melvin Jones
(74) *Attorney, Agent, or Firm*—Haynes and Boone, LLP

(57) ABSTRACT

A packaged air conditioner or heat pump unit is provided with an elongated removable drain pan having an inner longitudinal portion that underlies and receives condensate falling from the portion of the unit's indoor coil positioned within the conditioned air flow through the unit. An outer longitudinal portion of the drain pan underlies tubing portion return bends of the coil positioned outside of the conditioned air flow and separated from the inner longitudinal pan portion by a vertical dividing wall having a small condensate transfer hole therein. During cooling operation of the unit, the unit blower creates a negative pressure inwardly adjacent the hole which draws return bend condensation from the outer longitudinal pan portion into the inner longitudinal pan portion for drainage outwardly therefrom, with the condensate received from the balance of the coil, via a drain line connected to the pan.

20 Claims, 3 Drawing Sheets

AIR CONDITIONING APPARATUS AND ASSOCIATED CONDENSATE DRAIN PAN STRUCTURE

BACKGROUND OF THE INVENTION

The present invention generally relates to air conditioning apparatus and, in a representatively illustrated embodiment thereof, more particularly relates to condensate drain pan structures used in conjunction with air conditioning cooling coils.

A coil used in air conditioning apparatus such as furnaces, air handling units, heat pumps and packaged air conditioners extracts moisture from the air which is being flowed externally across the coil (by a blower portion of the apparatus and cooled by the coil for delivery to a conditioned space served by the apparatus. This moisture extraction creates condensation (water) on the exterior of the coil which drips from the coil into an associated drain pan structure within the outer housing of the air conditioning apparatus. Coil condensation dripping into the pan flows away therefrom by gravity via a condensate drain line suitably connected to the pan.

Packaged self-contained heat pumps and air conditioners are typically positioned outside of a building (such as on the roof or on the ground adjacent the building) which they serve. In several conventional designs of such a packaged unit its condensate drain pan underlies the portion of the cooling coil which is interposed in the return air/supply air conditioned air stream and catches and drains away condensate falling from this coil portion. However, in these conventional air conditioning apparatus designs, coil tubing return bends which are not disposed in the cool conditioned air stream project outwardly from an end of the coil and beyond the condensate-receiving periphery of the underlying drain pan.

Because packaged units of this type are normally positioned outdoors, it was not thought necessary to use a drain pan structure to catch and drain away this relatively minor condensate drippage from these exposed coil tubing return bends. However, in time, this minor condensate drippage tended to leak out of the housing of the packaged unit and, when observed by the owner of the unit, triggered "nuisance" service calls to fix what, in reality, was neither a defect in or a problem with the unit.

In view of this it would be desirable to provide a modified drain pan which additionally receives and drains away this coil tubing return bend condensate without having to modify the unit in which the drain pan is installed. It is to this goal that the present invention is directed.

SUMMARY OF THE INVENTION

In carrying out principles of the present invention, in accordance with a preferred embodiment thereof, a specially designed condensate drain pan is incorporated in an air conditioning apparatus, representatively a self-contained heat pump package unit, and is useable to catch, and drain away, condensate falling from the unit's indoor coil which functions as a cooling coil during use of the unit in a cooling mode. Such condensate is formed on the exterior of the coil as a blower portion of the unit draws air through the interior of its housing and across the cooling coil which is disposed therein.

The cooling coil has a main body portion disposed in the blower-created conditioned air stream, and a series of coil tubing return bends projecting outwardly from the main coil body portion and disposed outside of the conditioned air stream. The condensate drain pan is removably supported beneath the cooling coil and preferably has an elongated, generally trough-shaped body having a bottom wall, first and second opposite upstanding end walls, and an upstanding intermediate wall dividing the body into a first longitudinal portion extending between the first end wall and the intermediate wall and underlying the main coil body portion, and a second longitudinal portion extending between the intermediate wall and the second end wall and underlying the coil tubing return bends.

A condensate transfer opening is formed in the intermediate wall and intercommunicates the interiors of the first and second longitudinal portions of the drain body. The drain pan further includes a drain conduit structure connected to the first longitudinal portion of the body and having an inlet communicated with its interior.

During operation of the unit in a cooling mode, condensate from the main coil body falls into the first longitudinal drain pan portion and is drained away therefrom via the drain conduit structure. At the same time, condensate from the coil tubing return bends falls into the second longitudinal drain pan portion. Operation of the blower creates a negative pressure within the first longitudinal drain pan portion which draws the condensate from the second longitudinal drain pan portion inwardly through the condensate transfer opening into the interior of the first longitudinal drain pan portion. This transferred condensate is drained away from the interior of the first longitudinal drain pan portion via the drain conduit structure.

Illustratively, the drain pan is formed from a glass-filled polypropylene material, but could alternatively be formed from a variety of other suitable materials if desired. In the illustrated embodiment of the drain pan its first longitudinal portion has an upwardly concave bottom wall and an upstanding central rib with a bottom edge cutout area at the intermediate wall, the inlet of the drain conduit structure being disposed at this cutout area.

In the illustrated embodiment of the condensate drain pan, the drain conduit structure longitudinally extends transversely outwardly from the intermediate wall, with a longitudinal portion of the drain conduit structure being disposed within the second longitudinal drain pan portion. The second longitudinal portion of the body includes first and second laterally opposite bottom wall portions having upwardly concave configurations and projecting outwardly from circumferentially spaced apart outer side surface portions of the drain conduit structure. Preferably, the second bottom wall portion is disposed higher than the first bottom wall portion. This configuration of the second longitudinal drain pan portion facilitates the flow of condensate through the interior of the second longitudinal drain pan portion to the condensate transfer opening which is preferably disposed closely adjacent the juncture between the first bottom wall portion and the condensate drain conduit structure.

DETAILED DESCRIPTION

Figure 2:
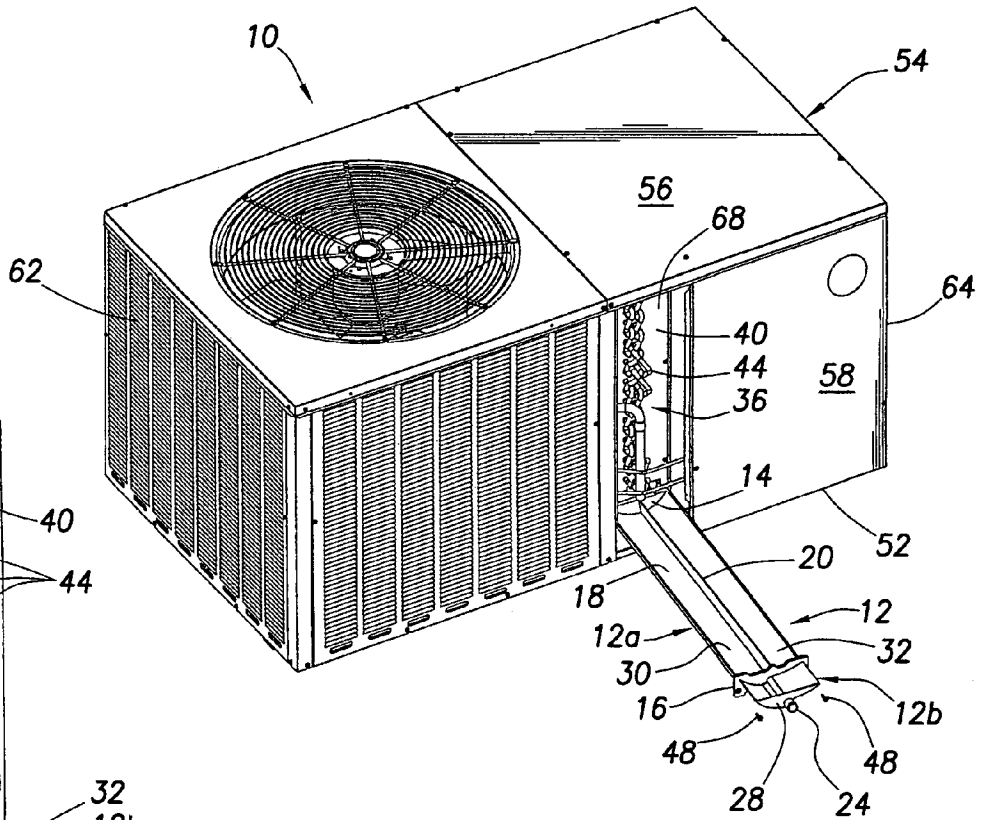
FIG. 2 is a front side perspective view of a representative self-contained heat pump package unit in which the drain pan is removably incorporated, the drain pan being shown in an outwardly extended inspection/maintenance position.
Figure 1:
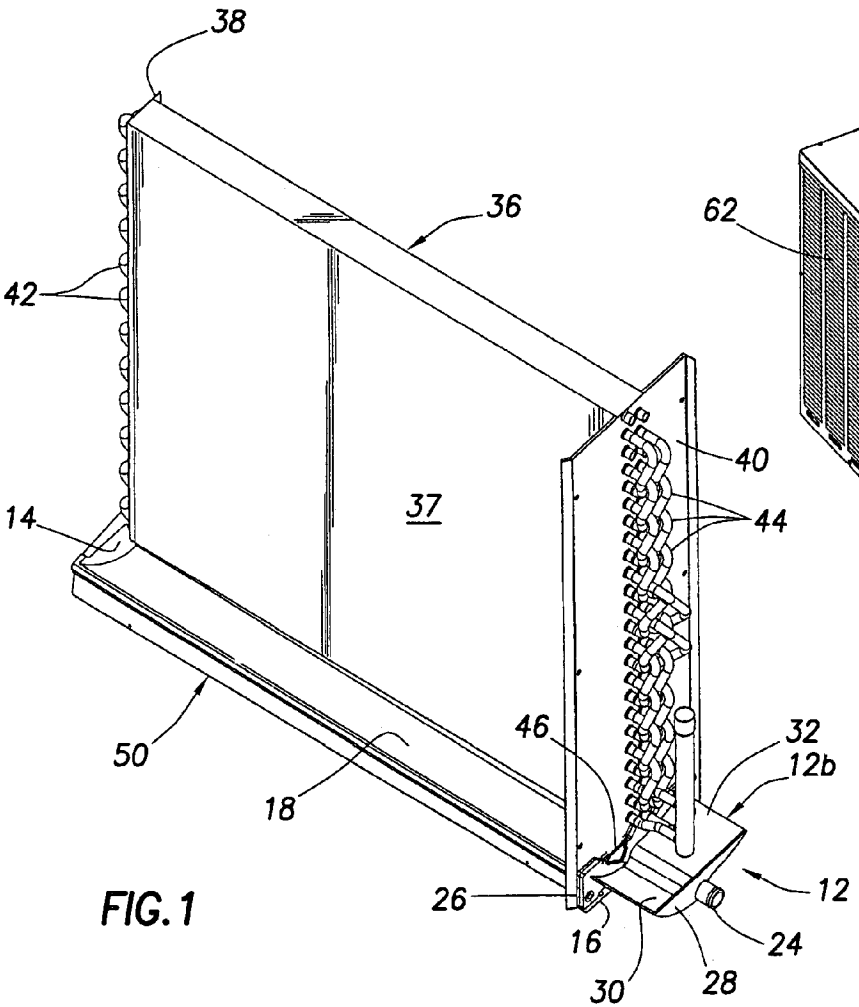
FIG. 1 is a perspective view of a cooling coil having operatively supported thereon a specially designed condensate drain pan embodying principles of the present invention, the drain pan being in its retracted operating orientation.

Referring initially to FIGS. 1 and 2, the present invention provides air conditioning apparatus, representatively in the form of a self-contained heat pump package unit 10, which incorporates therein a specially designed removable condensate drain pan 12 that embodies principles of the present invention. Illustratively, the self-contained heat pump package unit 10, in which the novel drain pan 12 is installed, is of a prior art configuration, but could alternatively be a self-contained packaged air conditioner of the same prior art configuration, or another type of air conditioning apparatus or unit requiring a condensate drain pan.

With reference now to FIGS. 5-9, the drain pan 12 (see FIG. 5) is representatively of a unitary, non-metallic construction, preferably being formed from a glass-filled polypropylene material, and has a horizontally elongated configuration with an inner longitudinal portion 12*a* and an outer longitudinal portion 12*b*. As described in greater detail below, the inner longitudinal drain pan portion 12*a* is similar to the prior art drain pan previously incorporated in the representatively illustrated package heat pump unit 10, while the outer longitudinal drain pan portion 12*b* represents a novel addition to and improvement of the previous drain pan, and is a key aspect of the present invention.

Figure 7:
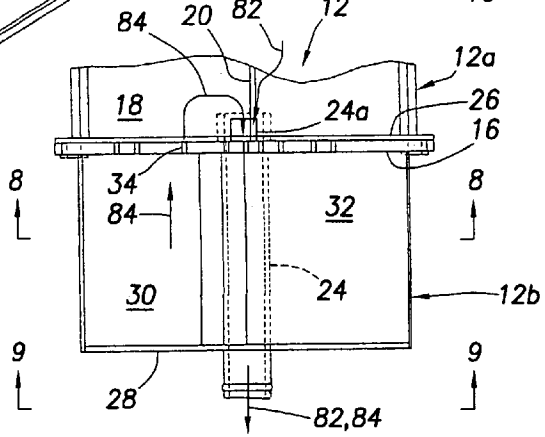
FIG. 7 is an enlarged top plan view of an outer end portion of the drain pan as shown in FIG. 5.
Figure 6:
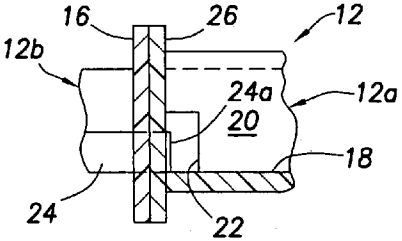
FIG. 6 is an enlarged scale schematic partial cross-sectional view through the drain pan taken generally along line 6-6 of FIG. 5.

The conventional inner longitudinal drain pan portion 12*a* includes inner and outer end walls 14,16 and an elongated base wall 18 extending between walls 14,16 and having, along its length, an arcuate, upwardly concave configuration. As illustrated, the wall 16 transversely projects outwardly beyond the base wall 18. From its opposite outer sides, base wall 18 laterally slopes downwardly and inwardly. Longitudinally extending along a central top side portion of the base wall 18, between the opposite end walls 14 and 16, is an elongated upstanding rib 20 having a bottom edge cutout area 22 (see FIG. 6) extending inwardly from the outer end wall 16. A tubular drain outlet fitting 24 extends outwardly from the outer end wall 16 and has an inlet 24*a* that communicates with a bottom interior area of the inner longitudinal drain pan portion 12*a* at the rib cutout area 22 as best illustrated in FIGS. 6 and 7. A suitable sealing gasket 26 is preferably secured to the inner side of the outwardly projecting portion of the outer end wall 16.

Figure 8:
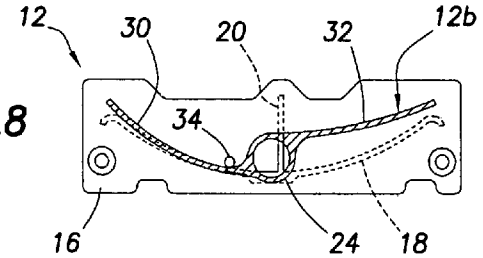
FIG. 8 is a cross-sectional view through the drain pan taken generally along line 8-8 of FIG. 7.
Figure 5:
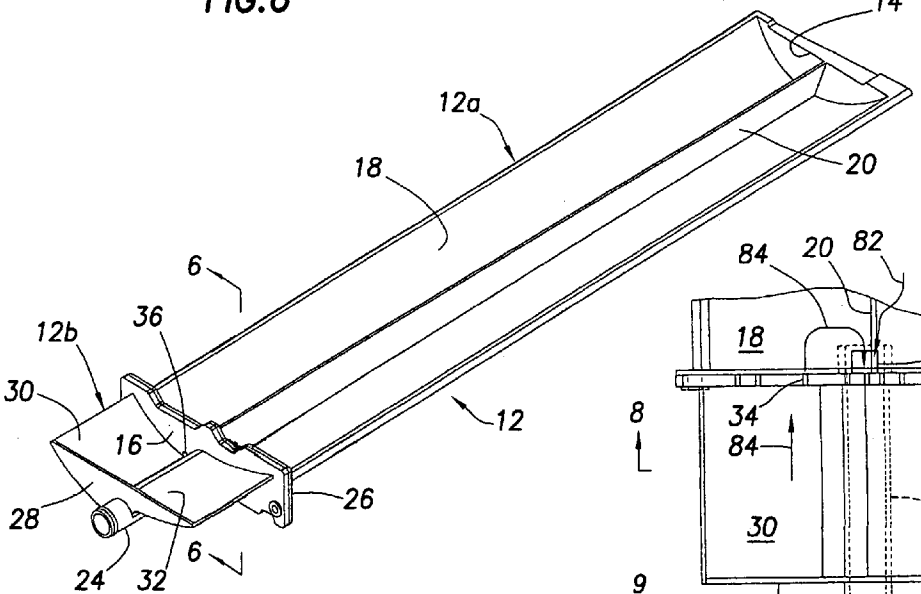
FIG. 5 is an enlarged scale perspective view of the drain pan removed from the cooling coil.

The new outer longitudinal drain pan portion 12*b* extends longitudinally outwardly from the wall 16, with the drain outlet fitting 24 extending through a bottom interior side portion of the drain pan portion 12*b* as best illustrated in FIGS. 5 and 8. Drain outlet fitting 24 has been somewhat lengthened to accommodate the novel addition to the overall drain pan 12 of the specially designed outer longitudinal drain pan portion 12*b*.

Figure 9:
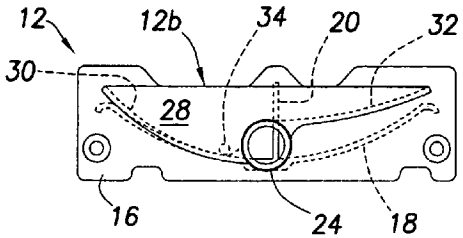
FIG. 9 is an outer end elevational view of the drain pan taken generally along line 9-9 of FIG. 7.

As best illustrated in FIGS. 5, 8 and 9, the outwardly extending drain pan portion 12*b* is generally trough-shaped and has an outer end wall 28 (making the end wall 16 of the drain pan portion 12*a* a longitudinally intermediate wall in the lengthened drain pan 12 of the present invention), and first and second upwardly concave side walls 30 and 32 sloping laterally inwardly and downwardly to circumferentially spaced apart outer side surface portions of the drain outlet fitting 24. According to another aspect of the present invention, for purposes later described herein, a small circular condensate transfer hole 34 is formed through the wall 16 upwardly adjacent the juncture between the side wall 30 and the drain outlet fitting 24, and communicates the interiors of the inner and outer longitudinal portions 12*a*,12*b* of the condensate drain pan 12. Both of the side walls 30,32 of the outer longitudinal drain pan portion 12*b* slope laterally inwardly and downwardly toward the condensate transfer hole 34 which is disposed upwardly adjacent a bottom interior side portion of the drain pan portion 12*b*. Side wall 32 is disposed somewhat higher than side wall 30.

The condensate drain pan 12, as best illustrated in FIG. 1, is removably and operatively supported beneath the indoor coil 36 of the illustrated heat pump unit 10 which, during the cooling cycle of the unit functions as a cooling coil that exteriorly generates condensate which falls therefrom. However, the condensate drain pan 12 may alternatively be utilized in conjunction with a variety of other types of condensate-generating cooling coils without departing from principles of the present invention.

With continuing reference to FIG. 1, coil 36 is of a fin and tube construction and has a main body portion 37 with a horizontally elongated rectangular shape. Coil body 37 has a horizontally inner end to which a coil plate 38 is mounted, and a horizontally outer end to which a substantially wider coil plate 40 is mounted. Tubing return bends 42 project horizontally outwardly from the plate 38, and tubing return bends 44 project horizontally outwardly from the plate 40. For purposes later described herein, a horizontally elongated opening 46 is formed through a bottom end portion of the coil plate 40.

The drain pan 12 is operatively installed beneath the coil 36 by longitudinally sliding the drain pan 12 (from its FIG. 1 removed orientation) inwardly through the outer coil plate opening 46 until the gasketed drain pan wall 16 is brought into abutment with the coil plate 40. Screws 48 (see FIGS. 1 and 2) are then threaded into aligned openings in the drain pan wall 16 and coil plate 40 to removably retain the inserted drain pan 12 beneath the coil 36. The inserted drain pan base wall 18 rests on an underlying, complementarily shaped support structure 50 (see FIG. 1) which, in turn is disposed within the interior of the packaged heat pump unit 10 and suitably secured to its bottom wall 52 (see FIGS. 2-4). The support structure 50 is configured in a manner such that the inserted drain pan 12 longitudinally slopes downwardly from its inner end wall 14 towards the 16.

Figure 4:
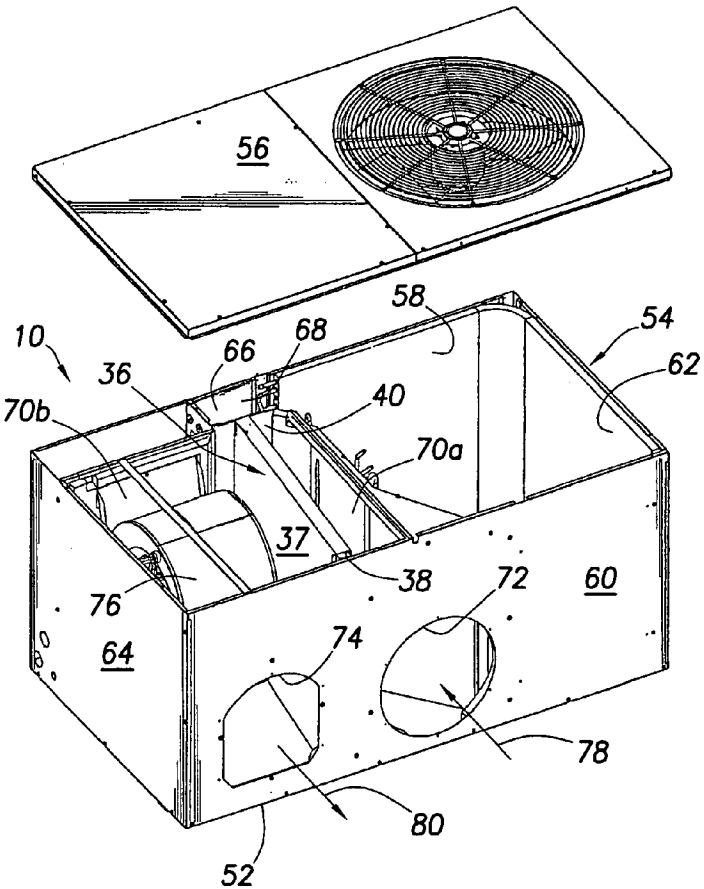
FIG. 4 is a partially exploded rear side perspective view of the heat pump unit with the drain pan in its retracted operating orientation.
Figure 3:
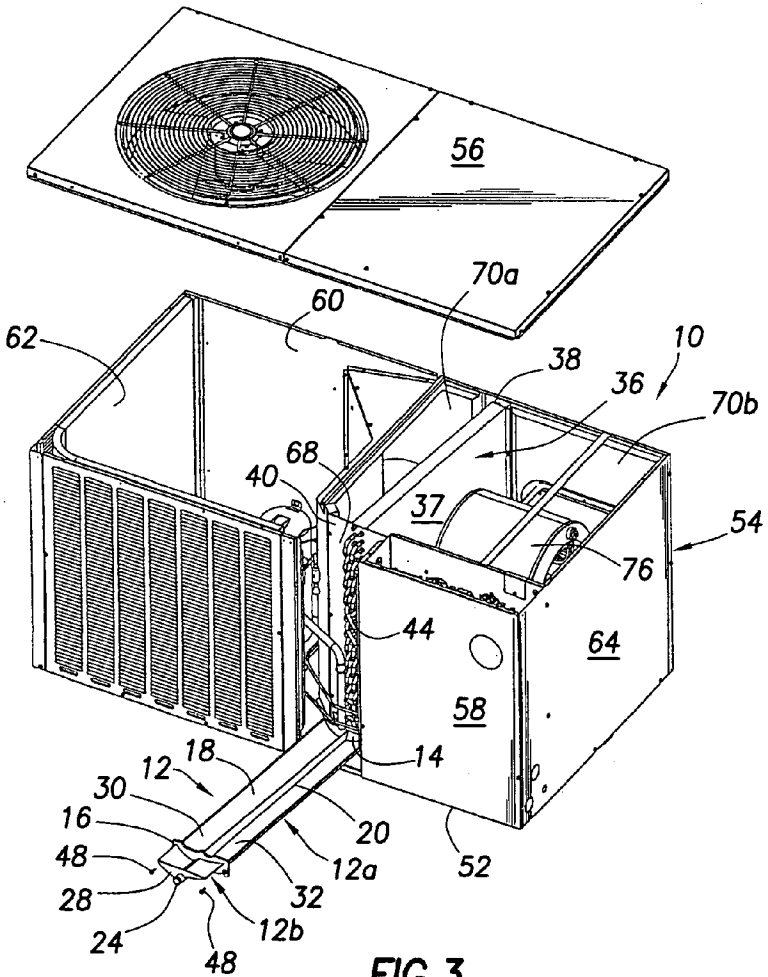
FIG. 3 is a partially exploded front side perspective view of the heat pump unit of FIG. 2.

As illustrated in FIGS. 2-4, the packaged heat pump 10 has a hollow rectangular housing 54 having, in addition to its bottom wall 52, a removable top wall 56, front and rear side walls 58 and 60, and opposite end walls 62,64. A removable access panel 66 on the front wall 58 (shown only in FIG. 4) covers a recessed area 68 disposed within front side of the heat pump interior and through which the drain pan 12 may be installed and removed.

The coil 36 is suitably supported within the interior of the heat pump housing 54 with the coil plate 40 forming the inner boundary of the recessed area 68, the coil tubing return bends 44 projecting into the recessed area 68 and overlying the open top side of the outer longitudinal portion 12*b* of the removably installed drain pan 12, and the main body 37 of the coil 36 overlying the open top side of the inner longitudinal portion 12*a* of the installed drain pan 12. A conditioned air flow plenum 70 extends inwardly from the housing end wall 64 and is divided by the coil 36 into a return portion 70*a* and a supply portion 70*b* (see FIGS. 3 and 4). Return and supply air openings 72,74 (see FIG. 4) are formed in the rear housing wall 60 and respectively communicate with the return and supply portions 70*a*,70*b* of the plenum 70. An air supply blower 76 is operatively disposed in the plenum 70*b* downstream from the coil 36.

During cooling operation of the heat pump. 10, the blower 76 draws return air 78 (see FIG. 4) from the conditioned building space served by the heat pump 10 into the plenum portion 70*a* via opening 72, across coil 36 to cool the return air 78, and then forces the now cooled air outwardly through the supply opening 74 in the form of cooled supply air 80 for delivery to the conditioned space. Suitable air ducts (not shown) may be appropriately connected to the return and supply openings 72,74 in a conventional manner to appropriately route the air flows 78,80 external to the heat pump 10. As can be seen, the blower 76, relative to the coil 36, operates in a "draw through" mode. This creates a negative pressure region adjacent the coil 36 and the inner side of the drain pan wall 16 that outwardly overlies the coil plate opening 46 (see FIG. 1).

Portion 12*b* of the installed drain pan 12, and the coil return bends 44, are disposed outside the blower-created air flow stream within the recessed area 68 of the housing 54. With reference now to FIG. 7, condensate 82 falling from the body 37 of the coil 36 drops into the open top side of the underlying inner longitudinal portion 12*a* of the drain pan 12, laterally drains toward a laterally central portion of the upwardly concave drain pan base wall 18, and longitudinally drains along the top side of the base wall 18 toward the drain pan 16 where, via the rib cutout area 22, the condensate 82 enters and flows outwardly through the drain outlet fitting 24. The upstanding central rib 20 acts as a protective barrier to prevent air flowing horizontally across the coil 36 from forcing condensate 82 out of the inner longitudinal drain pan portion 12*a*.

Also during cooling operation of the heat pump 10 (or another type of condensate-generating air conditioning apparatus in which the drain pan 12 is installed as the case may be), and according to a key aspect of the present invention, condensate 84 from the coil tubing return bends 44 falls into the open top side of the underlying outer longitudinal portion 12*b* of the drain pan. The blower-created negative pressure at the inner side of the drain pan wall 16 draws the condensate 84 inwardly through the condensate transfer hole 34 in the wall 16 into an outer end portion of the inner longitudinal portion 12*a* of the drain pan 12. Condensate 84 entering the drain pan portion 12*a* via the wall hole 34 then, by gravity, reverses direction and flows outwardly through the drain outlet fitting 24 with the flow of condensate 82.

With reference now to FIG. 8, the transfer to the wall hole 34 of the condensate 84 received by the outer longitudinal portion 12*b* of the drain pan 12 is facilitated by a novel configuration of its bottom wall structure. Specifically, both of the bottom side wall portions 30,32 of the drain pan extension portion 12*b* have an upwardly concave shape, with each of the side wall portions 30,32 extending outwardly from the drain outlet fitting 24, and the condensate transfer hole 34 being adjacent the juncture of the wall portion 30 and the drain outlet fitting 24. As previously noted, the side wall portion 32 is positioned higher than the side wall portion 30 and has a top side generally flush with the top side of the drain outlet fitting 24. Accordingly, condensate 84 falling onto the side wall 32 easily drains by gravity laterally across the drain outlet fitting 24 and into the lowest area of the wall 30 disposed at the condensate transfer hole 34.

As previously mentioned herein, the specially designed drain pan 12 of the present invention may be used to advantage in conjunction with air conditioning apparatus of types other than the illustrated heat pump 10 without departing from principles of the present invention. Additionally, while the negative pressure region within the unit housing 54, created by operation of the blower 76 and drawing the return bend condensate 84 into the inner longitudinal drain pan portion 12*a*, is representatively created by placing the blower 76 downstream from the coil 36, other apparatus and techniques for creating this negative pressure region within the housing 54 during blower operation (such as, for example, using a blow-through coil arrangement and a suitable venturi structure adjacent the condensate transfer hole 34) may be alternatively utilized without departing from principles of the present invention.

The foregoing detailed description is to be clearly understood as being given by way of illustration and example only, the spirit and scope of the present invention being limited solely by the appended claims.

What is claimed is:

1. Air conditioning apparatus comprising:

a wall structure defining an air flow passage;

a cooling coil from which condensate falls during use thereof, said cooling coil having a first portion disposed within said air flow passage and a second portion disposed externally thereto;

pressure-creating apparatus for creating a negative pressure within said air flow passage adjacent said first portion of said cooling coil; and a condensate drain pan having:

a first drain pan portion positioned to catch condensate falling from said first cooling coil portion, a drain conduit communicated with and operative to drain condensate from said first drain pan portion, a second drain pan portion positioned to catch condensate falling from said second cooling coil portion, and a wall section separating said first and second drain pan portions, said wall section having a condensate transfer opening therein through which said negative pressure is operative to draw condensate from within said second drain pan portion into said first drain portion for discharge therefrom through said drain conduit.

2. The air conditioning apparatus of claim 1 wherein:

said pressure-creating apparatus includes a supply air blower operative to flow air through said air flow passage and across said cooling coil.

3. The air conditioning apparatus of claim 2 wherein:

said supply air blower is operative to draw air across said cooling coil.

4. The air conditioning apparatus of claim 1 wherein:

said cooling coil is a fin-and-tube type cooling coil, said first cooling coil portion is a main body portion of said cooling coil, and said second cooling coil portion is defined by a series of coil tubing return bends projecting outwardly from said main body portion.

5. The air conditioning apparatus of claim 1 wherein:

said air conditioning apparatus is a self-contained packaged unit.

6. The air conditioning apparatus of claim 1 wherein:

said first drain pan portion has an upwardly concave bottom wall with a laterally central upstanding rib disposed thereon and having a bottom edge cutout area at said wall section, and said drain conduit has an inlet disposed within said first drain pan portion at said cutout area.

7. The air conditioning apparatus of claim 1 wherein:

said drain conduit longitudinally extends transversely to and outwardly from said wall section, and said second drain pan portion has upwardly concave, laterally opposite first and second bottom wall portions projecting laterally outwardly from circumferentially spaced apart outer side portions of said drain conduit.

8. The air conditioning apparatus of claim 7 wherein:

said second bottom wall portion is higher than said first bottom wall portion.

9. The air conditioning apparatus of claim 8 wherein:

said condensate transfer opening is disposed adjacent the juncture between said first bottom wall portion and said drain conduit.

10. Air conditioning apparatus comprising a condensate drain pan having:

an elongated, generally trough-shaped body having a bottom wall, first and second opposite upstanding end walls, and an upstanding intermediate wall dividing said body into a first longitudinal portion extending between said first end wall and said intermediate wall, and a second longitudinal portion extending between said intermediate wall and said second end wall;

a condensate transfer opening formed in said intermediate wall and intercommunicating the interiors of said first and second longitudinal portions of said body; and a drain conduit structure connected to said first longitudinal portion of said body and having an inlet communicated with its interior.

11. The air conditioning apparatus of claim 10 wherein:

said drain conduit structure longitudinally extends transversely outwardly from said intermediate wall, with a longitudinal portion of said drain conduit structure being disposed within said second longitudinal portion of said body, and said second longitudinal portion of said body includes first and second laterally opposite bottom wall portions having upwardly concave configurations and projecting outwardly from circumferentially spaced apart outer side surface portions of said drain conduit structure.

12. The air conditioning apparatus of claim 11 wherein:

said second bottom wall portion is disposed higher than said first bottom wall portion.

13. The air conditioning apparatus of claim 10 further comprising:

a cooling coil which, during use thereof, generates condensate on its outer surface, said condensate drain pan being operatively supported beneath said cooling coil in a manner such that condensate falling from a first portion of said cooling coil falls into said first longitudinal portion of said drain pan, and condensate falling from a second portion of said cooling coil falls into said second longitudinal portion of said drain pan.

14. The air conditioning apparatus of claim 13 wherein:

said first portion of said cooling coil is a main body portion thereof, and said second portion of said cooling coil is defined by a series of coil tubing return bends projecting outwardly from said main body portion of said cooling coil.

15. For use with a cooling coil having a main body portion from which a series of tubing return bends outwardly project, a method of flowing away from the coil condensate formed on the exteriors of the main body portion and the tubing return bends during use of the cooling coil, said method comprising the steps of:

positioning a drain pan beneath said cooling coil, said drain pan having a first portion underlying said main body portion of said cooling coil, and a second portion underlying said tubing return bends and being separated from said first portion by a wall section having a condensate transfer opening therein;

communicating an inlet of a drain conduit with the interior of said first portion of said drain pan;

permitting condensate to fall from said main body portion of said cooling coil into said first portion of said drain pan for drainage therefrom via said drain conduit;

permitting condensate to fall from said tubing return bends into said second portion of said drain pan;

creating a negative pressure within said first portion of said drain pan; and utilizing said negative pressure to draw condensate from said second portion of said drain pan through said condensate transfer opening into said first portion of said drain pan for drainage therefrom via said drain conduit.

16. The method of claim 15 wherein:

said cooling coil is disposed in a housing, and said creating step includes the step of flowing air through said housing and across said cooling coil.

17. The method of claim 15 wherein:

said cooling coil has an end plate with an opening therein, and said positioning step includes the step of inserting a portion of said drain pan through said opening in said end plate.

18. The method of claim 15 wherein:

said positioning step is performed using a drain pan formed from a non-metallic material.

19. The method of claim 15 wherein:

said positioning step is performed using a drain pan formed from a glass-filled polypropylene material.

20. The method of claim 15 wherein:

said positioning step is performed using a drain pan having a unitary construction.

* * * * *